US005304762A

United States Patent [19]

Hiltbrunner

[11] Patent Number: 5,304,762

[45] Date of Patent: Apr. 19, 1994

[54] NOVEL GAS-BLAST CIRCUIT BREAKER

[75] Inventor: Hugo Hiltbrunner, Vicques, Switzerland

[73] Assignee: Sprecher Energie AG, Oberentfelden, Switzerland

[21] Appl. No.: 13,833

[22] Filed: Feb. 5, 1993

[30] Foreign Application Priority Data

Feb. 6, 1992 [CH] Switzerland ..... 00348/92-6

[51] Int. Cl.[5] ..... H01H 33/90

[52] U.S. Cl. ..... 200/148 A; 200/148 H; 200/148 BV

[58] Field of Search ..... 200/148 R, 148 A, 148 B, 200/148 H, 148 BV

[56] References Cited

U.S. PATENT DOCUMENTS

| | | | |
|---|---|---|---|
| 4,160,888 | 7/1979 | Natsui et al. | 200/148 A |
| 4,220,838 | 9/1980 | Thaler et al. | 200/148 A |
| 4,302,645 | 11/1981 | Thaler | 200/148 A |
| 4,327,262 | 4/1982 | Kull | 200/148 A |
| 4,598,188 | 7/1986 | Schotzau et al. | 200/148 A |
| 4,880,946 | 11/1989 | Thuries et al. | 200/148 A |
| 4,945,198 | 7/1990 | Thuries et al. | 200/148 A |
| 4,983,789 | 1/1991 | Thuries | 200/148 A |
| 4,992,634 | 2/1991 | Thuries et al. | 200/148 R |

FOREIGN PATENT DOCUMENTS

| | | |
|---|---|---|
| 2349205 | 11/1977 | France . |
| 655611 | 4/1986 | Switzerland . |

*Primary Examiner*—J. R. Scott

*Attorney, Agent, or Firm*—Keck, Mahin & Cate

[57] ABSTRACT

The gas-blast circuit breaker has passages in the pump piston which connect the pump space to the arcing space surrounding the quenching tube and to the surrounding space located within the circuit breaker housing. These passages are held closed during switching-off and open during switching-on by valve devices. For this purpose, in one embodiment the pump piston is used as a valve seat and an annular disk is used as a valve body which is common to the first valve and to the second valve, the first valve controlling the passage between the pump space and the surrounding space, and the second valve controlling the passage between the pump space and the arcing space. When switching-off large currents, the piston is subjected to an overpressure in the switching-off direction, which overpressure is produced by switching gas flowing into the arcing space, in order to support the drive. The valves are prevented from opening due to the pressure in the pump space. During switching-on, the pump space is enlarged and the arcing space is reduced in size, causing the annular disk to be raised off the pump piston against the spring prestressing it by means of the reduced pressure in the pump space and the overpressure in the arcing space. Thus, the pump and arcing spaces are able to communicate with the surrounding space and to ensure pressure equalization without the drive having to apply more energy during switching-on than in the case of a circuit breaker without an arcing space.

9 Claims, 4 Drawing Sheets

NOVEL GAS-BLAST CIRCUIT BREAKER

FIELD OF INVENTION

The present invention relates to a novel gas-blast circuit breaker.

BACKGROUND OF THE INVENTION

A type of gas-blast circuit breaker is disclosed in EP-A-0,380,907. When switching-off large currents, quenching gas is flowing into an arcing or blow-out space supporting the drive. In order to prevent an overpressure in the arcing or blow-out space during switching-on, which overpressure requires increased work from the drive, slide-like valves are provided which release passages, running in the radial direction, in the cylinder bounding the arcing space during switching-on as a consequence of overpressure produced in the arcing space, with respect to the pressure in the pump space, in order to ensure pressure equalization between the arcing space and the surrounding space. In order to control these valves, a control piston is displaceably supported in the pump piston which separates the pump space from the blow-out or arcing space. This control piston has further passages which connect the arcing space to the pump space and are closed by means of a valve element which opens automatically in the event of an overpressure in the arcing space with respect to the pump space, in order to allow quenching gas to flow into the pump space during switching-on.

This known circuit breaker has the disadvantage that a considerable pressure difference must be built up between the pump space and the arcing space in order to open the slide-like valves, which requires drive energy. Also, at the start of a switching-off stroke, the slide-like valves must initially be moved into a closed position again resulting in the pump space being enlarged by the displacement of the control piston. This has the consequence that the pressure built up in the pump space is less than necessary to avoid adversely affecting the switching-off capability of the circuit breaker. Furthermore, such slide-like valves result in a complicated construction of the gas-blast circuit breaker.

SUMMARY OF THE INVENTION

The object of the present invention is therefore to develop a novel gas-blast circuit breaker of this type which will have improved switching properties and yet a simple construction. Further, the drive will not need to carry out significantly more work during switching-on of the circuit breaker than in the case of a circuit breaker without an arcing space.

This object is achieved by means of a gas-blast circuit breaker which has the features and properties as described herein.

According to the invention, the valves are spring loaded in the closed direction, so that they are always in the closed position during pressure equalization between the corresponding spaces. The complete switching-off stroke can thus be utilized for producing pressure in the pump space. Since it is necessary to ensure only that the valves are closed during pressure equalization, the spring force acting on the valve bodies can be kept extremely small so that the work required to open the valves during switching-on of the circuit breaker is negligibly small. The coupling between the valves prevents the second valve from opening during switching of large currents and as a consequence of the rising pressure, in this case in the blow out or arcing space, the result is that the drive is supported. In order that quenching gas can flow from the pump space through the axial passage in the moving contact piece into the arcing space, it is fundamentally necessary that the pressure in the arcing space is always less or equal to than the pressure in the pump space. It is thus possible, without problems, to keep the second valve closed by means of the valve body of the first valve, to which valve body the pressure in the pump space is applied.

A particularly preferred embodiment of the gas-blast circuit breaker according to the invention is achieved when the valve bodies are rigidly connected to one another. This construction is particularly simple and the two valves are opened and closed simultaneously.

A particularly space-saving construction of the valves is achieved if they are arranged coaxially with respect to one another.

A further particularly preferred and space-saving embodiment of the gas-blast circuit breaker according to the invention is for the pump space and blow-out space to be axially aligned separated by the pump piston.

A likewise particularly preferred embodiment of the gas-blast circuit breaker according to the invention, is achieved when the pump piston has first passages connecting the pump space to the surrounding space, and second passages connecting the pump space to the blow-out space, the valves have seats arranged in a plane on the pump piston on the side facing the pump space, and a valve body, which is common to both valves, constructed as a plate. This is an extremely simple and space-saving construction.

A further preferred embodiment according to the invention enables construction of the active area of the valve body to be quite large, which results in the valves opening at very low pressure differences during switching-on.

In the gas-blast circuit breaker according to the invention, the valves are always reliably closed in a very simple manner during switching-off.

A likewise particularly preferred gas-blast circuit breaker according to the invention has the advantage that scarcely any more work is required from the drive when switching-off small currents than is required in a gas-blast circuit breaker without an arcing space.

DESCRIPTION OF THE DRAWINGS

The present invention will now be explained in more detail using exemplary embodiments which are shown in the drawing and in which, purely schematically:

FIG. 2 shows a part of the gas-blast circuit breaker in the same representation as in FIG. 1, but enlarged showing both the switched-on and switched-off conditions, the portion below center-axis 16 illustrating the switched-off position, and the portion above axis 16 illustrating the open-valve condition as the circuit breaker is switched-on;

DETAILED DESCRIPTION OF PREFERRED EMBODIMENTS

Figure 1:
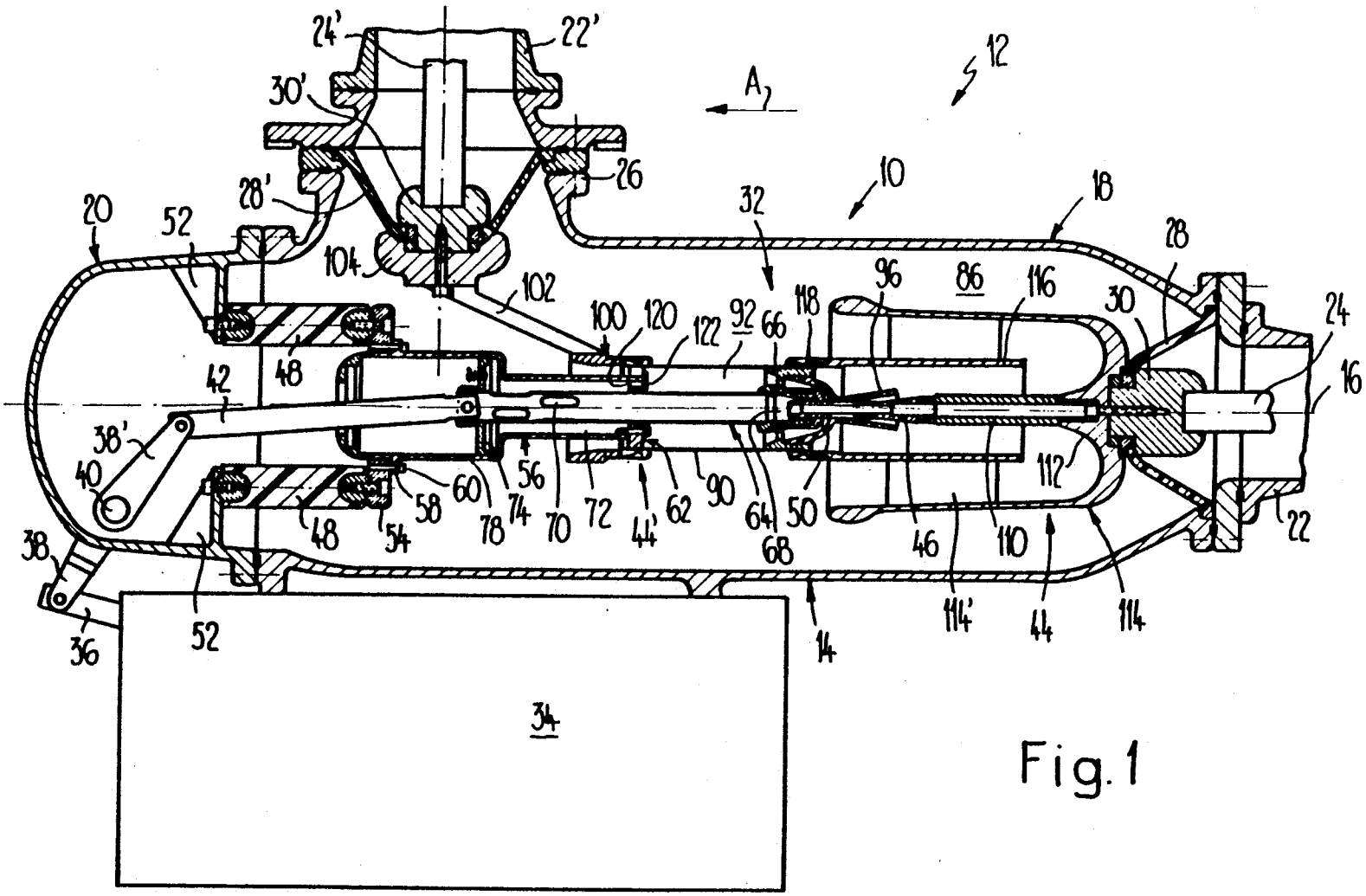
FIG. 1 shows a longitudinal section through a pole of an encapsulated gas-blast circuit breaker according to the invention.

FIG. 1 shows a pole 10 of a gas-blast circuit breaker 12 of a metal-encapsulated high-voltage switching installation, in longitudinal section. In the region of the pole 10, the encapsulation or housing 14 has a tubular breaker tank 18 which is approximately rotationally symmetrical (cylindrical) with respect to the horizontal axis 16. Housing 18 is closed at one end by means of a flanged-on cover 20. Encapsulation tube 22 for a first connecting conductor 24 is flanged on housing 18 at the other end. On the upper side, the breaker tank 18 has a connecting flange 26 to which an encapsulation tube 22' for a second connecting conductor 24' is attached in a gastight manner. In the connecting region of the encapsulation tubes 22, 22' to the breaker tank 18, insulating cones 28, 28' are attached to the encapsulation 14 in a gastight manner. Contact elements 30, 30' pass through the insulating cones 28, 28' in their central regions. The internal space, which is bounded by the breaker tank 18, is partitioned off with respect to the internal spaces which are bounded by the encapsulation tubes 22, 22', by means of these insulating cones 28, 28' and the contact elements 30, 30', which are attached thereto and into which the corresponding connecting conductors 24, 24' engage in an electrically conductive manner. The latter internal spaces are filled with an insulating gas, for example $SF_6$, which is at an overpressure with respect to the environment.

Arranged in the space bounded by the breaker tank 18 and the cover 20 is a puffer switching element 32, which can be operated by means of a drive 34, which is indicated schematically, for example, a generally known stored spring-force drive. The drive 34 is provided underneath the breaker tank 18 and is attached thereto. The output drive rod 36 of the drive 34 is articulated on an outer first lever 38 of a lever shaft 40 which passes through the cover 20 in a gastight manner and supports, in the interior of the cover 20, a second lever 38' on whose free end region an insulating drive rod 42 for the puffer switching element 32 is articulated.

The puffer switching element 32 has a first switching element part 44, which is supported via the insulating cone 28 and has the stationary contact piece 46, and a second switching element part 44', which is supported on the cover 20 via supporting insulators 48 and has the moving contact piece 50. Integrally formed on the cover 20 are supporting flanges 52 which project into the internal space and on which in each case is mounted one cylindrical supporting insulator 48, which extends parallel to the horizontal axis 16. At the other end, a metallic supporting ring 54 is attached to the supporting insulators 48 by means of screws, in a generally known manner.

Figure 2:
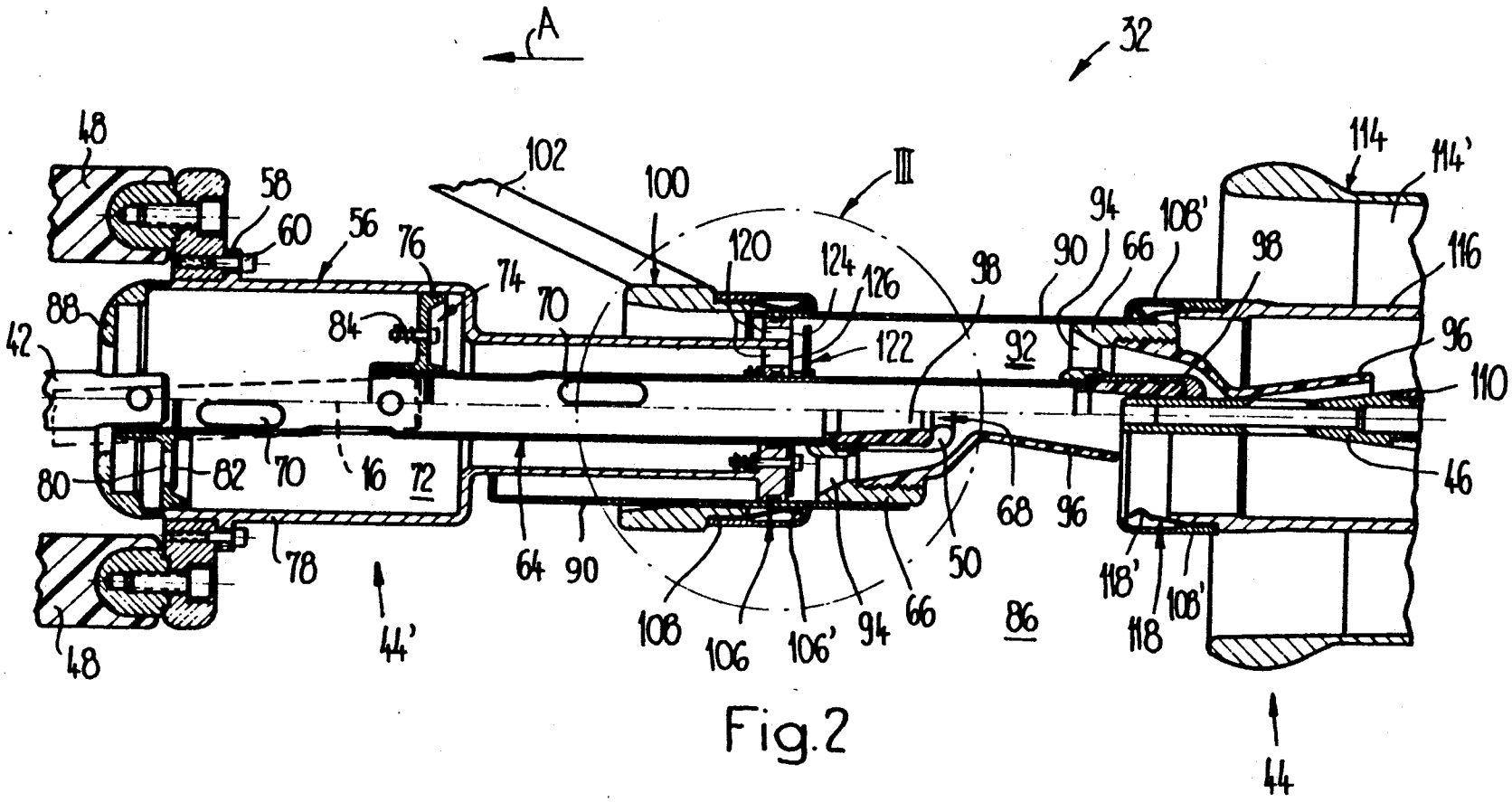

As can also be seen, especially from FIG. 2, a tube 56 passes through the supporting ring 54, which tube 56 is coaxial with respect to the horizontal axis 16 and has outwardly projecting attachment tabs 58 through which attachment screws 60, which are screwed into the supporting ring 54, pass. For improved clarity, FIG. 1 does not indicate all the reference symbols relevant to the puffer switching element 32.

Seen in the direction of the horizontal axis 16 from the cove 20, the tube 56 is tapered in a stepped manner approximately centrally and, on its end facing the first switching element part 44, carries a pump piston 62 which projects beyond the tube 56 in the radial direction. A quenching tube 64 passes through the annular pump piston 62, which quenching tube 64 is firmly connected at its end facing the first switching element part 44 to a cylinder base 66 which carries the tulip-like moving contact piece 50 on the end facing away from the quenching tube 64. This moving contact piece 50 has an axial passage 68 which starts from the free end, opens into the quenching tube 64 and is connected in flow terms via radial openings 70 in the quenching tube 64, in the end region remote from the free end of the moving contact piece 50, to an arcing or blow-out space 72. This arcing space is bounded radially externally by the tube 56 and, in the axial direction, at one end by the pump piston 62 and at the other end by a piston 74 which is attached to the quenching tube 64 and hence moves with the moving contact piece 50. This disk-like piston 74, which surrounds the quenching tube 64, is supported slidably displaceably on its outer side or periphery via a sealing ring 76 riding on the tube 56 in its region having an enlarged free diameter. At the end on this side, the quenching tube 64 is closed by means of a peg and is articulated on the drive rod 42. The region of the tube 56 having a larger diameter thus forms a cylinder 78 which interacts with the piston 74.

The piston 74 has large-area axial flow passages 80 which are closed by an annular-disk-like valve body element 82 such that they can be released. The valve body element 82 is arranged on the side of the piston 74 which faces the arcing space 72 and acts as a valve seat, and is prestressed in the closed position via compression springs 84. The piston 74 and the valve body element 82 thus form a non-return valve with a free passage from the surrounding space 86, which is bounded by the breaker tank 18 and the cover 20, into the arcing space 72. A suitable check valve can, of course, be provided instead of the non-return valve. The drive-side end of the tube 56 is covered by a cap 88 which surrounds the drive rod 42 at a distance, spaced from, in order to improve the dielectric properties.

The pump piston 62 is surrounded by a tubular pump cylinder 90, which likewise surrounds by the cylinder base 66 and is attached thereto. The pump cylinder 90, the cylinder base 66 and the pump piston 62 bound a pump space 92 which can be subjected to pressure when a switching-off stroke is carried out in the arrow direction A from the switched-on position shown in FIG. 1 and at the top in FIG. 2 into the switched-off position shown at the bottom in FIG. 2 (below axis 16).

The pump space 92 communicates via flow openings 94 in the cylinder base 66 with the inlet of a blowing nozzle 96 consisting of insulating material, which is attached to the cylinder base 66 in a known manner and surrounds the moving contact piece 50. In the switched-on position, the tubular, stationary contact piece 46 passes through the blowing nozzle 96, which contact piece 46 engages with its free end region into the axial passage 68 of the moving contact piece 50, and interacts with the latter. An annular flow body 98, composed of insulating material, for example Teflon, is provided in an undercut of the tulip-like moving contact piece 50 in order to avoid flow losses through slots in the moving contact piece 50 and to improve the flow conditions in the axial passage 68, and hence the quenching response for the arc.

The pump cylinder 90 is surrounded by a contact ring 100 from which a supporting arm 102 projects and which, on its free end, carries a mating contact element 104 which is attached to the contact element 30' by means of a screw. The contact ring 100 is surrounded by a crown-like sliding contact piece 106 having self-sprung sliding contact fingers 106', which project beyond the contact ring 100 in the axial direction and rest on the pump cylinder 90. The sliding contact piece 106 is covered by an annular cap 108 which clamps the sliding contact piece 106 firmly between itself and the contact ring 100. The stationary contact piece 46 is screwed into a contact tube 110 by means of its end region facing away from the second switching element part 44'. Contact tube 110 for its part is attached to a central deflection connecting 112 of a shielding cap 114 which surrounds but is spaced from the contact tube 110 and the stationary contact piece 46. Ribs 114' project radially inwards from this shielding cap 114, and carry a tubular contact supporting element 116 which surrounds but is spaced from the stationary contact piece 46 and the contact tube 110. The end region of the contact supporting element 116 facing the second switching element part 44' is surrounded by a further sliding contact piece 118 having sliding contact fingers 118' which project beyond the contact supporting element 116. Sliding contact piece 118 is covered by an annular cap 108' which clamps the sliding contact piece 118 firmly between itself and the contact supporting element 116. The contact supporting element 116 is constructed in the region of the sliding contact piece 118 identically to the contact ring 100. The sliding contact piece 118, as well as the annular cap 108', have an identical construction to the sliding contact piece 106 and the annular cap 108. The sliding contact piece 118 interacts with the pump cylinder 90 when the circuit breaker is switched on, in order to pass the continuous current.

The pump piston 62 is provided with passages 120 which connect the pump space 92 to the surrounding space 86 and to the arcing space 72. These passages 120 are closed by valve means 122 which open automatically during switching-on in order in this case to connect or communicate both the arcing space 72 and the pump space 92 to the surrounding space 86 in flow terms.

Figure 3:
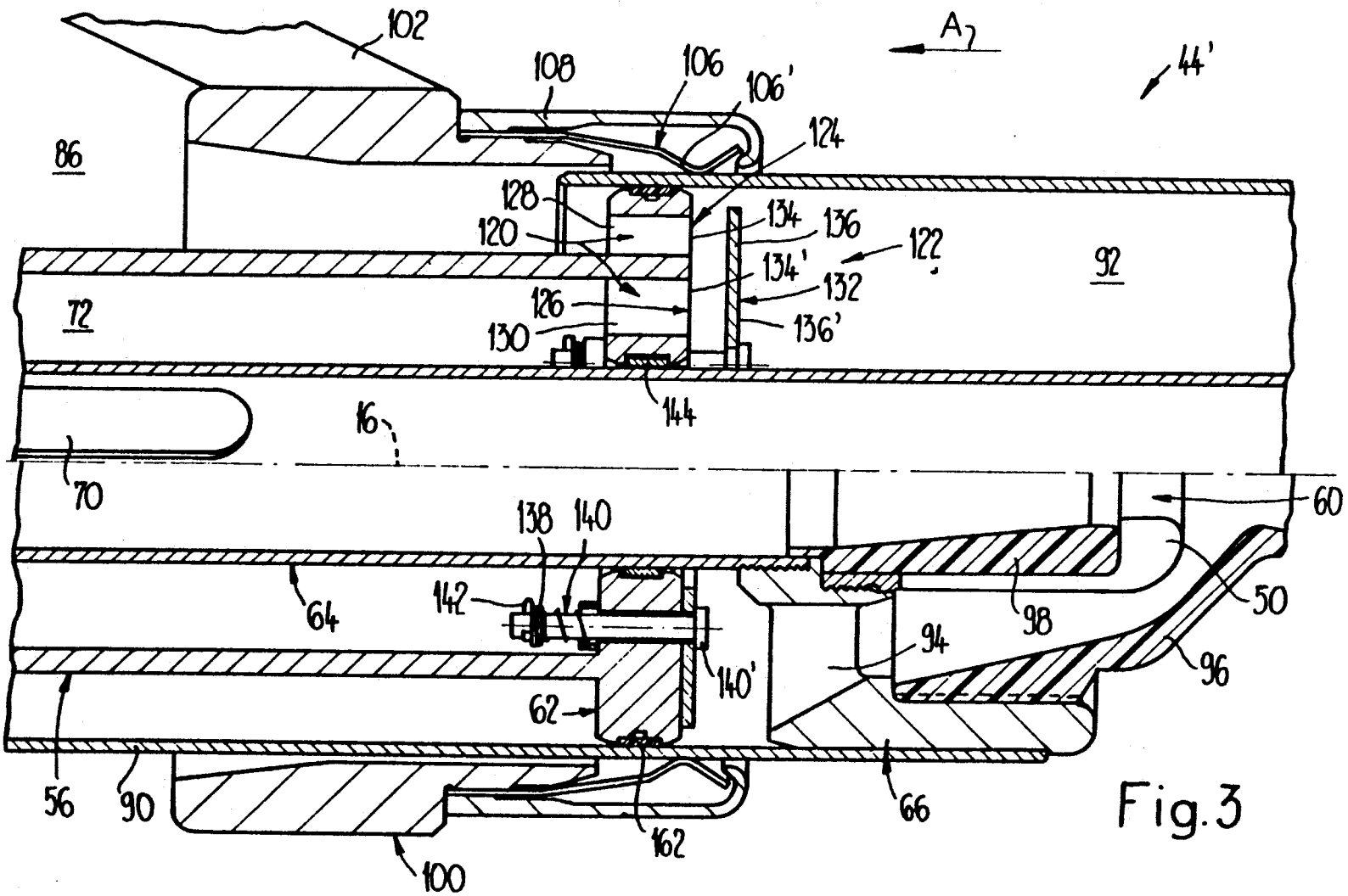
FIG. 3 enlarges the region of the gas-blast circuit breaker designated by dotted circle III in FIG. 2 (the portion below axis 16 again illustrating the switched-off position, the portion above axis 16 the open-valve condition)
Figure 4:
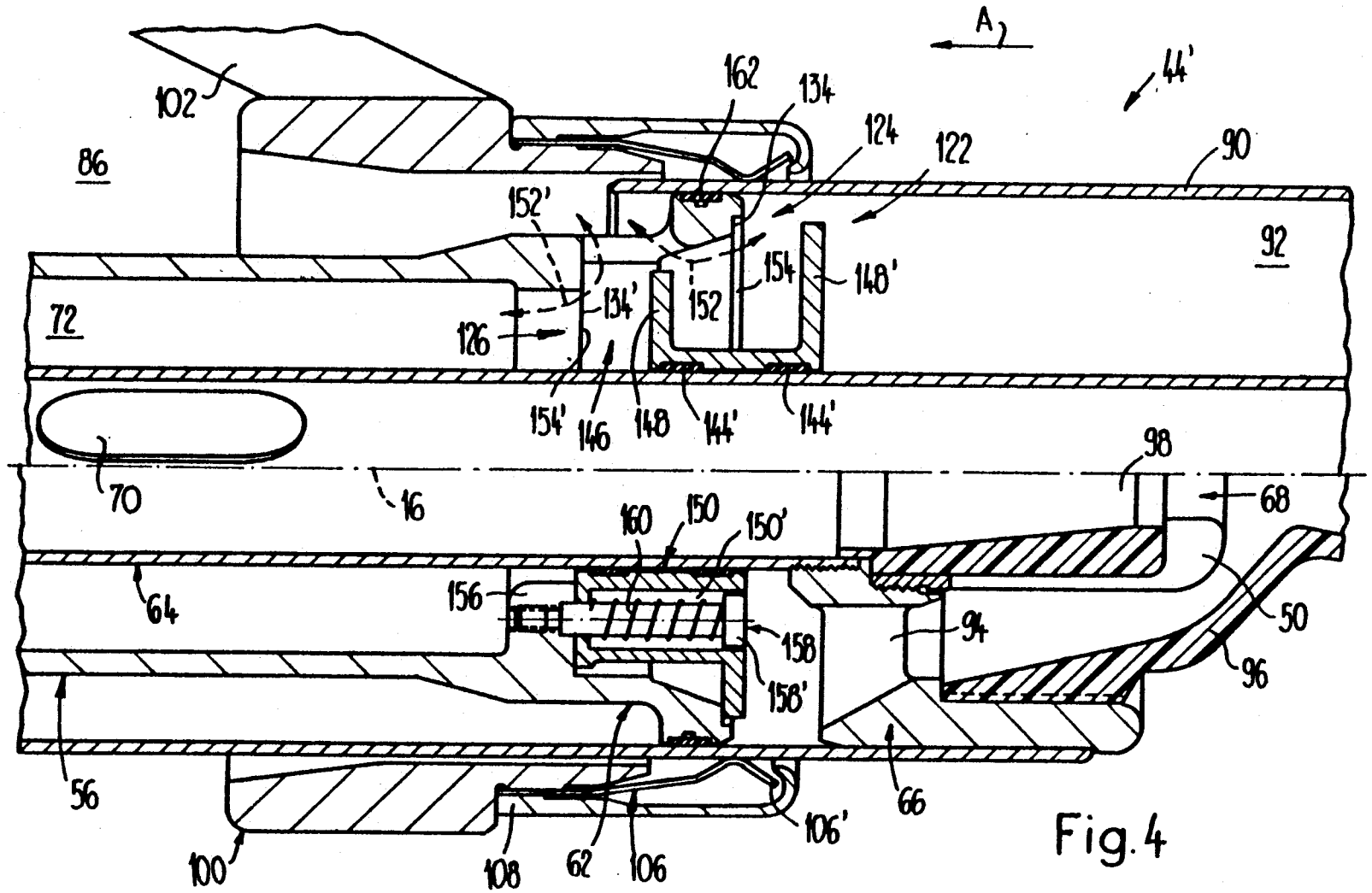
FIG. 4 shows a second embodiment of the gas-blast circuit breaker according to the invention, in the same representation as in FIG. 3.

Two embodiments of the pump piston 62 having differently arranged passages 120 and differently constructed valve means 122 are shown enlarged in FIGS. 3 and 4. Above the horizontal axis 16, the gas-blast circuit breaker 12 is shown respectively at the end of a switching-on stroke against the arrow direction A. Underneath or below the horizontal axis 16, it is shown respectively in the switched-off position. In both embodiments; the valve means 122 have a first valve 124 between the pump space 92 and the surrounding space 86, and, in the case of the embodiment according to FIG. 3, a second valve 126 between the arcing space 72 and the pump space 92, and in the case of the embodiment according to FIG. 4, a second valve 126 between the arcing space 72 and the surrounding space 86.

The pump piston 62 according to FIG. 3 is provided with first passages 128, which run in the axial direction, are arranged radially outside the tube 56 and are kidney-like or elongated holes in cross section. Second passages 130 are arranged radially inside the tube 56 and are likewise kidney-like or elongated holes in cross section. The first passages 128 thus connect the pump space 92 to the surrounding space 86. The pump space 92 is connected to the arcing space 72 through the second passages 130. The flat pump piston 62 on the pump space side interacts with a flat, plate-like annular disk 132 which covers the first and second passages 128, 130. The pump piston 62 thus forms the valve seats 134 and 134' of the first and second Valves 124, 126 respectively, whose valve body 136, 136' is formed by the annular disk 132. The pressure in the pump space 92 acts on the annular disk 132, which acts as the valve body 136, 136', in the closing direction, and the pressure in the arcing space 72 acts in the opening direction through the second passages 130.

The annular disk 132 is prestressed in the closed direction by means of compression springs 138 which are supported at one end of the pump piston 62 on the side facing the arcing space 72, and at the other end on an expanding or cotter pin 142 which passes through a shaft 140. Each shaft 140 passes through the pump piston 62 and the annular disk in the axial direction and is supported on this side by means of its integrally formed head 140' on the annular disk 132. The cross section of the first passages 128 is at least of equal size to, or larger than, the cross section of the second passages 130.

The tube 56, which passes through the pump piston 62 centrally, is guided in a sealing, sliding manner via a sliding ring 144 thereon.

In the case of the embodiment shown in FIG. 4, the valve seats 134, 134' for the first and second valves 124, 126 respectively are integrally formed one behind the other in the axial direction on the pump piston 62. The annular pump piston 62 surrounds the quenching tube 64 at a distance so that a piston passage 146 is formed which expands in a stepped manner from the arcing space 72 into the pump space 92. The piston passage 146 opens in the radial direction into the surrounding space 86 between these step-like expansions. Provided in the piston passage 146 is an annular-disk-like valve body 148 which projects outwards in the radial direction from an annular body 150 which surrounds the quenching tube 64 and is supported displaceably thereon. This valve body 148 divides the piston passage 146 into two paths which are indicated by dashed lines, the first path 152 connecting the pump space 92 to the surrounding space 86, and the second path 152' connecting the arcing space 72 to the surrounding space 86. A second annular-disk-like valve body 148' is integrally formed on the annular body 150, offset in the axial direction towards the pump space 92 with respect to the valve body 148. Each of these valve bodies 148, 148' interacts by means of its radially outer end region with a corresponding step 154, 154' of the pump piston 62. These steps 154, 154' are thus the valve seats of the first valve 124 between the pump space 92 and the surrounding space 86, as well as of the second valve 126 between the arcing space 72 and the surrounding space 86.

Screws 158 are screwed into retaining tabs 156 which are integrally formed on the pump piston 62 and project in the direction of the piston passage 146 with respect to the second valve 126 on the side facing the arcing space 72, which screws 158 project with their shank and head 158' into recesses 150' which are integrally formed on the annular body 150, and the shank of which screws is surrounded by a compression spring 160, which is supported at one end on the head 158' and at the other end, in the case of the base of the recess 150', on the annular body 150. The valve bodies 148, 148' are prestressed in the closed direction via these compression springs 160.

The annular body 150 is supported via two sliding rings 144' on the quenching tube 64, such that it is sealed and can be displaced in the direction of the axis 16.

For the sake of completeness, it should be mentioned that, in the case of both embodiments shown in FIG. 3 and 4, the pump piston 62 is integrally formed on the tube 56. On the circumference side or outer periphery, the pump piston 62 is in each case surrounded by a sealing ring 162 in order to guide the pump cylinder 90 on the pump piston 62 in a sliding manner, at the same time to insulate these parts electrically with respect to one another, and to prevent compressed gas flowing out of the pump space 92. For its part, the cylinder 90 is surrounded by the contact ring 100 with the sliding contact piece 106 and the annular cap 108. As the switched-off position shown below the horizontal axis 16 respectively shows, the quenching tube 64, the blowing nozzle 96, which is produced from insulating material, for example Teflon, and the moving contact piece 50 are screwed to the cylinder base 66. It can also easily be seen from these figures that the flow body 98 surrounded by the moving contact piece 50 covers the slots in this contact piece 50.

When the gas-blast circuit breaker 12 is switched on, as is shown in FIG. 1 and in FIGS. 2–4 respectively above the horizontal axis 16, the majority of the current flows from the first connecting conductor 24 through the contact element 30 to the shielding cap 114, through its ribs 114' to the contact supporting element 116, and via the sliding contact piece 118 to the pump cylinder 90, from the latter through the sliding contact piece 106, the contact ring 100, the supporting arm 102 to the mating contact element 104, which is connected to the contact element 30' and passes the current to the second connecting conductor 24'. The remaining, considerably smaller, current component flows from the shielding cap 114 through the contact tube 110, the stationary contact piece 46, the moving contact piece 50 and the cylinder base 66 to the pump cylinder 90. Since the overlap of the sliding contact piece 118 and of the pump cylinder 90 is less than the overlap of the stationary contact piece 46 and the moving contact piece 50, the current commutates onto the contact pieces 46, 50 as soon as the pump cylinder 90 is separated from the sliding contact piece 118 during switching-off. The arc which occurs during the subsequent separation of these contact pieces 46, 50 is thus blown using the quenching gas which is subjected to pressure in the pump space 92, and is quenched by said gas.

The specific method of operation of the gas-blast circuit breaker 12 described above during the various switching operations is as follows.

During switching-on, the moving contact piece 50 together with the blowing nozzle 96, the pump cylinder 90, the quenching tube 64 and the piston 74 are moved against the arrow direction A into the switched-on position. At the same time, the pump space 92 is enlarged and the arcing space 72 is reduced in size. The overpressure thus produced in the arcing space 72 and the reduced pressure in the pump space 92 result in the annular disk 132 being raised off the pump piston 62, which acts as a valve seat, (FIG. 3) or the valve bodies 148, 148' being raised off the corresponding steps 154, 154', which are constructed on the pump piston 62 and act as valve seats, (FIG. 4) and, at the same time, the corresponding passages 120, 128, 130, 146 and paths 152, 152' being released. Since the compression springs 138 and 160 are of very weak construction, extremely little energy is required to open the valves 124, 126. During switching-on, the non-return valve in the piston 74 remains closed. As soon as the gas-blast circuit breaker 12 is switched on and pressure equalization between the surrounding space 86 and the arcing space 72 and pump space 92 is completed, the first and second valves 124, 126 close simultaneously because of the spring prestressing.

During switching-off, the moving contact piece 50 and the parts which are moved with it are moved from the switched-on position in the arrow direction A through a switching stroke into the switched-off position. In this case, the pump space 92 is reduced in size and the arcing space 72 is enlarged, the increase in size of the arcing space 72 being greater than the reduction in size of the pump space 92, because of the larger area of the piston 74 with respect to the area of the pump piston 62. Until separation of the moving contact piece 50 from the stationary contact piece 46, virtually no compressed gas, or only very little compressed gas, can flow out of the pump space 92. In order to avoid a reduced pressure in this phase in the arcing space 72, and hence energy loss, the valve body element 82 releases the flow passages 80 in the piston 74. The first and second valves 124, 126 are closed because of overpressure produced in the pump space 92.

If no current, or only a small current, is now to be interrupted, the gas flowing out of the pump space 92 after the separation of the two contact pieces 46 and 50 is not heated up or is heated up only slightly. Furthermore, only a part of this gas flows through the axial passage 68 of the moving contact piece 50 and the quenching tube 64 into the arcing space 72, and the other part of the gas flows through the stationary contact piece 46 and the blowing nozzle 96 directly into the surrounding space 86. Since the quantity of quenching gas flowing into the arcing space 72 is not able to compensate for the reduced pressure in the arcing space 72, the non-return valve in the piston 74 continues to remain open in order to avoid reduced pressure in the arcing space 72 and hence more energy having to be applied by the drive 34.

When switching-off large currents, in contrast, the quenching gas which is subjected to pressure in the pump space 92 and flows out therefrom is sharply heated, which leads to a considerable pressure increase in the arcing space 72 with respect to the surrounding space 86, although only a part of the quenching gas flows through the axial passage 68 and the quenching tube 64 into the arcing space 72. Since the non-return valve in the piston 74 is now closed, the overpressure in the arcing space 72 in comparison with the pressure in the surrounding space 86 supports the drive. Although in this case the pressure in the arcing space 72 acts on the annular disk 132 and on the valve body 148 in the opening direction, the second valve 126 remains closed because the annular disk 132 (FIG. 3) and the valve body 148' (FIG. 4) respectively are subjected to higher pressure on the pump space side. Furthermore, the active area of the annular disk 132 which is subjected to the pressure in the pump space 92 is larger than the active area which is subjected to the pressure in the arcing space 72; this is also correspondingly true in the case of the embodiment according to FIG. 4, for the valve bodies 148' and 148 which are rigidly connected to one another.

It is also conceivable for no flow passages 80 to be provided in the piston 74. This has absolutely no influence on the operation of the first and second valves 124, 126. The only effect is that, during switching-off without any current or with only a small current, an under pressure is produced in the arcing space 72 which requires more energy from the drive 34.

It is, of course, also conceivable to use the puffer switching element in a gas-blast circuit breaker whose surrounding space is bounded by an insulator.

What is claimed is:

1. A gas-blast circuit breaker comprising:

a housing and first and second switching elements within a surrounding space adapted for containing a quenching gas and defined by the housing, the first switching element comprising a stationary contact piece, and the second switching element comprising a stationary tube, a pump piston connected to the stationary tube at a first end closest to the first switching element, and a moving contact piece arranged to move coaxially along and partially within the stationary tube, the moving contact piece comprising:

a quenching tube defining an axial passage, a free end and a blowing nozzle at the free end into which the stationary contact piece passes in a switched-on position, a pump cylinder surrounding the quenching tube and slidingly contacting the pump piston such that the pump cylinder, quenching tube and pump piston define a pump space which can be subjected to pressure during a switching-off stroke, a blow-out piston mounted on the quenching tube and slidingly contacting the stationary tube in a region remote from the free end such that the blow-out piston, pump piston, quenching tube and stationary tube define a blow-out space, the volume of which is enlarged during a switching-off stroke, and communication means for allowing quenching gas to move between the blow-out space, the pump space and the surrounding space during switching-on and valve means for opening and closing the communications means, the communications means having a first passage means between the pump space and the surrounding space and a second passage means between the blow-out space and one of the group consisting of the pump spaced and surrounding space, the valve means comprising a first valve adapted for opening and closing the first passage means and a second valve adapted for opening and closing the second passage means, the valve means responding to overpressure in the pump space to act on a valve body of the first valve in the closing direction, and overpressure in the blow-out space to act on a valve body of the second valve in the opening direction, the valves being spring loaded in the closing direction and coupled to one another to hold the second valve closed when the first valve is closed.

2. The gas-blast circuit breaker as claimed in claim 1, wherein the valve bodies of the first and second valves are rigidly connected to one another.

3. The gas-blast circuit breaker as claimed in claim 1, wherein the valve bodies of the first and second valves are arranged coaxially with respect to one another.

4. The gas-blast circuit breaker as claimed in claim 1, wherein the pump space and the blow-out space are arranged one behind the other in the axial direction and are separated from one another by the pump piston, and wherein the first and second passage means are located in the pump piston such that the passage means connect the pump space to the surrounding space and to the blow-out space, and said passage means are releasably closed by means of the valve bodies of the first and second valves.

5. The gas-blast circuit breaker as claimed in claim 4, wherein the first passage means includes first passage connecting the pump space to the surrounding space, and the second passage means includes second passages connecting the pump space to the blow-out space, the valves have seats arranged substantially coplanar with the pump piston on a side facing the pump space, and the valve bodies being common to both valves, constructed as a plate.

6. The gas-blast circuit breaker as claimed in claim 4, wherein the first passage means includes first passages connecting the pump space to the surrounding space, and the second passage means includes further passages connecting the blow-out space to the surrounding space, the valves have seats arranged one behind the other in the axial direction on the pump piston, and the valve bodies of the valves can be displaced in the axial direction.

7. The gas-blast circuit breaker according to claim 1, wherein the valve body of the first valve is at least as large as the valve body of the second valve.

8. The gas-blast circuit breaker according to claim 7, wherein the valve body of the first valve is larger than that of the second valve.

9. The gas-blast circuit breaker according to claim 1, the moving contact piece further comprising a non return valve means for permitting free passage of the gas from the surrounding space into the blow-out space.

* * * * *